US005101542A

United States Patent [19]

Nakagawa et al.

[11] Patent Number: 5,101,542

[45] Date of Patent: Apr. 7, 1992

[54] FIBER SEPARATOR FOR PRODUCING FIBER REINFORCED METALLIC OR RESIN BODY

[75] Inventors: Narihito Nakagawa; Yasumasa Ohsora, both of Ube, Japan

[73] Assignee: UBE Industries, Ltd., Yamaguchi, Japan

[21] Appl. No.: 503,625

[22] Filed: Apr. 3, 1990

[30] Foreign Application Priority Data

Apr. 5, 1989 [JP] Japan ..... 1-84735
Apr. 5, 1989 [JP] Japan ..... 1-84736

[51] Int. Cl.[5] ..... D01D 11/02
[52] U.S. Cl. ..... 28/282; 19/65 T
[58] Field of Search ..... 28/281, 282, 283; 19/65 T

[56] References Cited

U.S. PATENT DOCUMENTS 2,244,203 6/1941 Kern ..... 19/65 T
3,130,453 4/1964 Haigler, Jr. ..... 28/282
3,465,399 9/1969 Sokolowski et al. ..... 28/282
3,592,371 7/1971 Wyatt et al. ..... 28/282
3,708,832 1/1973 Lohrke ..... 28/282
3,840,941 10/1974 Neveu ..... 28/282 X
4,850,301 7/1989 Green, Jr. et al. ..... 28/283 X

FOREIGN PATENT DOCUMENTS 60-23255 5/1985 Japan .
1514465 6/1969 United Kingdom ..... 28/282
1326679 8/1973 United Kingdom .

*Primary Examiner*—Werner H. Schroeder
*Assistant Examiner*—John J. Calvert
*Attorney, Agent, or Firm*—Finnegan, Henderson, Farabow, Garrett & Dunner

[57] ABSTRACT

A fiber separator for separating a bundle of fibers into individual fibers comprising a composite roller composed of a plurality of roller elements, each having the same bulging thick-center profile. The roller elements are provided to revolve along a circle so that the fiber bundle comes into contact with them alternately, while preferably they are not free to rotate about their respective axes arranged along the circle. The fiber separator is preferably used in preparing a fiber reinforced metallic or resin body.

4 Claims, 2 Drawing Sheets

FIBER SEPARATOR FOR PRODUCING FIBER REINFORCED METALLIC OR RESIN BODY

BACKGROUND OF THE INVENTION

1. Field of the Invention

The present invention relates to a fiber separator for separating a bundle of fibers into individual fibers preferably for use in producing a fiber reinforced metallic or resin body.

2. Description of the Related Art

In recent years, there has been developed a fiber reinforced metallic body using a reinforcing fiber such as alumina fiber, silica fiber, silicon carbide fiber, boron fiber, nitrosilicate fiber, carbon fiber or the like with a matrix metal such as aluminium, magnesium, titanium, copper or the like. Such a fiber reinforced metallic body has been used for various kinds of mechanical parts or structural members in many fields of industry.

Japanese Examined Patent Publication No 62-27142 discloses an apparatus for producing such a fiber reinforced metallic body, which apparatus is of the following arrangement.

A drum with a bundle of such fibers as discussed above wound thereon is mounted for rotation at an inlet of the apparatus for supplying the fiber bundle into the apparatus. A pair of upper and lower fiber separating drums defining a nip therebetween are provided downstream of the fiber supply drum. The paired drums are forced to rotate for feeding the fiber bundle from the supplying drum through the nip. A fiber separator is provided between the supply drum and the paired fiber separating drums for blowing air onto the fiber bundle laterally or in a direction perpendicular to a fiber feed direction to thereby render the fiber bundle to be separated into individual fibers which are to be forced to pass through the drum nip. A plasma spray device for plasma-spraying a matrix metal, as discussed above, is provided downstream of the paired drums. Downstream of the plasma-spraying device, there are provided a heating device, a pressing device and a winding drum in this order. The separated fibers are forced to move toward the winding drum. While moving, the fibers are subjected to the plasma-spray of a molten metal or melt with the result that a prepreg sheet having a lower dense metallic surface and an upper spongy metallic surface is formed with the separated fibers being embedded within a metal deposition. The prepreg sheet thus formed is then softened using the heating device and is pressed using the pressing device to form a fiber reinforced metallic sheet, which is then wound on by the winding drum.

With the above prior art apparatus, however, there is a problem residing in that irregularity in a degree of fiber separation is likely to occur due to the blowing of a pressurized air with the result that a uniform fiber separation with a desired fiber orientation cannot be attained.

In this regard, a process has been proposed for use in preparation of a fiber reinforced resin body, wherein such fiber separation is effected while the fibers are forced to move through nips defined by a plurality of paired rollers. This, however, does not always attain a satisfactory effect in fiber separation.

SUMMARY OF THE INVENTION

An object of the present invention is to provide a new fiber separator which overcomes the above mentioned problems. According to the present invention, there is provided a fiber separator for separating a bundle of fibers into individual ones, preferably for use in producing a fiber reinforced metallic or resin body. The fiber separator comprises a separating roller composed of a plurality of bulging thick-center roller elements having their respective axes arranged along a circle. The roller elements are provided to revolve in combination with a common rotation shaft along the circle. The rotation shaft is connected to the roller elements by means of a pair of connecting members, and is driven to rotate by a motor. Each roller element is fixed to the connecting members at its opposite ends so that it is prevented from rotating about its axis.

Preferably, each bulging thick-center roller element has a profile rotation-symmetrical about its axis. The symmetrical profile, in a cross-sectional view taken along the axis, has opposite smooth surface lines of an oppositely convex form. The opposite surface lines are symmetrical to a center line of the roller perpendicular to the axis. A width between the opposite surface lines in a perpendicular direction is increased in an axial direction toward the center line.

DESCRIPTION OF THE PREFERRED EMBODIMENTS

Figure 1:
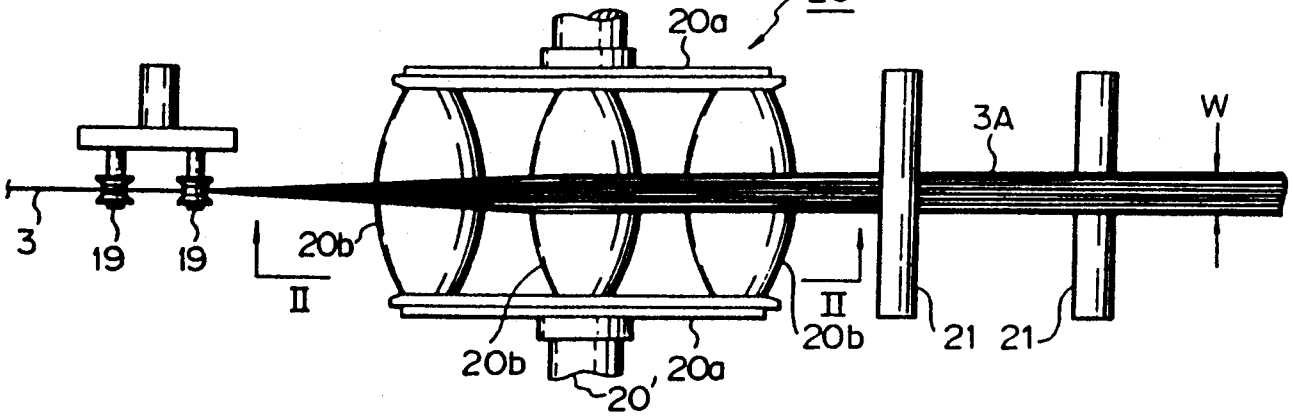
FIG. 1 is a plan view showing a fiber separation device of the present invention, which separator is to be incorporated in an apparatus as shown in FIG. 3.
Figure 3:
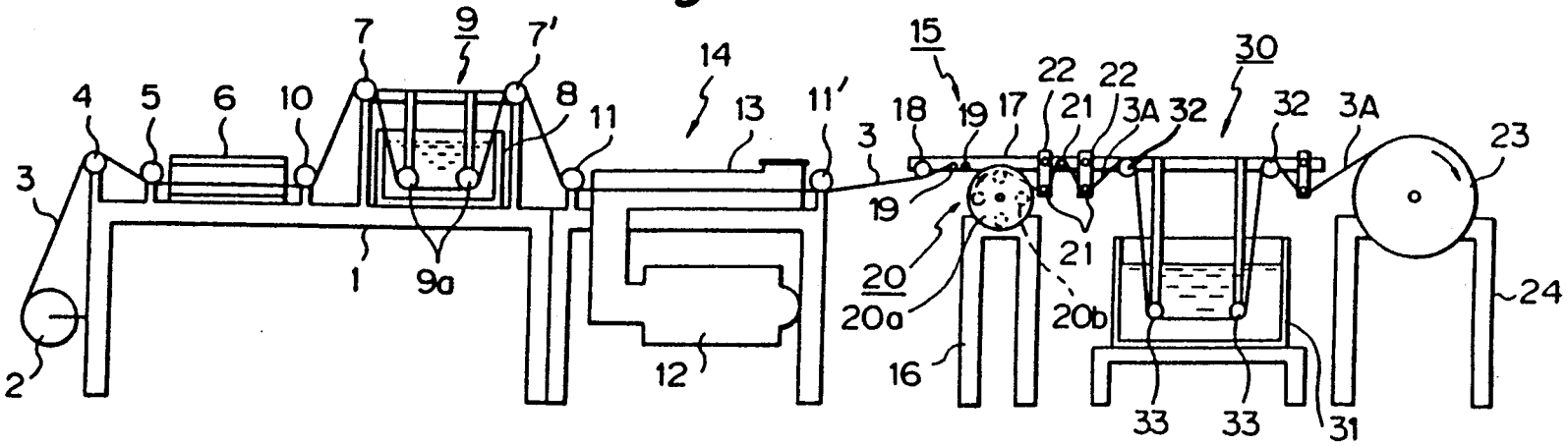
FIG. 3 shows an apparatus for performing a process of preparing reinforcing fibers to be used for a fiber reinforced metallic body, according to the present invention.
Figure 2:
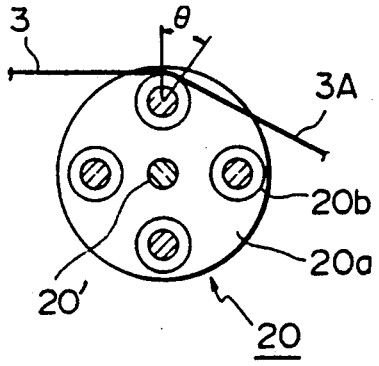
FIG. 2 is a cross-sectional view taken along the line II—II in FIG. 1.

Referring to FIGS. 1 to 3 an apparatus for carrying out a process of preparing reinforcing fibers according to the present invention as shown in FIG. 3. The apparatus comprises a fiber separator as shown in FIGS. 1 and 2.

In the apparatus, there is provided a drum 2 mounted rotatably on a base 1 at an end of the apparatus. The drum 2 has a bundle 3 of fibers 3A to be treated, which was wound thereon in a proceeding process. The fibers 3A to be treated are monofilaments and, may be, for example, silicon carbide fibers nitrosilicate fibers, nitrobride fibers, inorganic Si-Ti fibers produced by sintering polymetallic carbosilane ("Tirans fibers", trademark of the applicant) or Zr-C-O inorganic fibers. The fiber bundle 3 consists of about 200 to about 10,000 fibers 3A, each having a diameter of, for example, 10 μm. The number of fibers 3A in the bundle 3 depends on the types and diameters of the fibers.

The fiber bundle 3 is drawn from the initial drum 2 to pass through the apparatus, by a final drum 23, which is provided at the opposite end of the apparatus to wind the fibers 3A thereon.

The fiber bundle 3 runs at a constant speed in the apparatus, and is guided by guiding rollers 4, and 5 to an electric furnace 6 for desizing.

There are provided a plurality of guiding rollers 7, 10, and 11 downstream of the furnace. Between the rollers 10 and 11, an ultrasonic infiltrating device 9 is provided having a vessel 8 containing an aluminum paste and a pair of dipping rollers 9*a* therein. Downstream of the roller 11, a drying device 14 having a hot air blower 12 and a drying furnace 13 is provided between the roller 11 and a roller 11'.

Numeral 15 in FIG. 3 denotes the fiber separator of the present invention as shown in FIG. 1, which is provided downstream of the roller 11'.

The fiber separator 15 comprises a separating roller 20 composed of four roller elements 20*b*, a base 16 and a horizontally extending frame 17 for supporting a rotatable roller 18, fixed rollers 21 and grooved guide rollers 19. In FIG. 1, the frame 17, however, is omitted. The roller elements 20*b* are fixed to a pair of opposite disk plates 20*a* to form the separating roller 20 in such an arrangement that their axes are located along a circle, and each roller element is spaced apart equally from the neighboring ones. A rotation shaft 20' extends through both the disk plates 20*a* at a center of the circle, but is fixed thereto and is supported on the frame 17 rotatably by means of bearings (not shown). A motor (not shown) is provided to rotate the separating composite roller 20 or rotate the disk plates 20*a* with the roller elements 20*b*. The roller elements 20*b* per se are therefore, revolved along the circle by the motor, but are not free to rotate about their axes, while the separating composite roller 20 per se is rotated with the rotation shaft 20'.

The roller elements 20*b* are of the same size and of the same bulging thick-center profile symmetrical about the respective axis. The roller elements 20*b* are preferably made of teflon, alumina, titania or so.

The separating composite roller 20 composed of the four roller elements 20*b*, forces the fiber bundle 3 to come in contact with the separating composite roller 20 intermittently while it is running and the separating composite roller 20 is rotating. In particular, the fibers are forced to alternately come in contact with each of the roller elements 20*b* sequentially.

The separating composite roller 20 forces the fiber bundle 3 to be separated into individual fibers at a bulging surface of each of the roller elements 20*b* in such a manner that the fiber bundle is flattened along the bulging surface with a separation width W as shown in FIG. 1.

The flattened fiber bundle having the separation width W forms a plurality of fiber layers in a piled manner.

When a circumferential speed of the revolving roller elements 20*b* is lower than a running speed of the fiber bundle 3, separated fibers are likely to gather together. In this regard, it is preferable to determine the circumferential speed of the roller elements 20*b* to be the same as or a little bit higher than a running speed of the fiber bundle 3. The running speed of the fiber bundle may be at a level of 1 to 3 m/min, and thus the circumferential speed of the roller elements can be adjusted to a desired value relative to the fiber running speed.

The bulging thick-center roller elements 20*b* have a radius of curvature preferably of 30 mm to 100 mm in consideration of the fact that the smaller the curvature radius, the larger a width of the fiber separation is, but the fibers are likely to be apart from a center line of the roller element.

Preferably, the fiber bundle is forced to run along a center line of the separating composite roller 20. If a contact angle $\theta$ of the fiber bundle 3 with one of the roller elements 20*b* is larger with a fixed radius of curvature, a fiber separation width W becomes larger. A preferable contact angle $\theta$ is about 45° or less.

One of the fixed rollers 21 is connected to the frame 17 and the other one is connected to a bracket 22 connected to the frame 17, so that the fixed rollers 21 are in upper and lower positions, respectively. The upper and lower fixed rollers 21 in combination cause the fiber bundle 3 to be kept flattened with the fiber separation width W being kept constant. Downstream of the fixed tensioning rollers 21, there is provided a hybrid treatment device 30, which comprises a vessel 31 containing a suspended solution of SiC powder, guiding rollers 32 and dipping rollers 33. By this device 30, the separated fibers 3A are subjected to a hybrid treatment with the effect that: the fibers are provided with an enhanced uniform separation characteristic; the fibers are improved so that the fibers are prevented from being damaged or deteriorated in a subsequent process for preparing a fiber reinforced metallic body (which will be explained herein later); and adhesion of the fiber to a matrix metal is improved in the subsequent process.

The final drum 23 is mounted rotatably on a base 24 located downstream of the lower fixed roller 21 to wind the separated fibers. The final drum is rotated by the motor. Numeral 21' is also a tensioning roller.

With the above apparatus, a fiber bundle 3 wound on the initial drum 2 runs through the apparatus and the fibers are wound by the final drum 23 thereon via the various rollers 4, 5, 10, 7, 9*a*, 7', 11, 11', 18, 19, 20 (20*a*), 21, 32, 33, and 21' by rotating the final drum 23. The rotation of the final drum 23 is adjusted so that a running speed of the fiber bundle 3 is substantially constant over the entire winding operation from an initial stage to a final stage.

The fiber bundle 3 rewound from the initial drum 2 is first introduced into the electric furnace 6. The fibers 3A were subjected to a sizing treatment using a binding agent in a previous process to form the fiber bundle 3. In this connection, the binding agent adhered to the fibers is removed in the furnace 6. The fiber bundle 3 is then introduced into the ultrasonic infiltrating device 9, where aluminum paste contained in the vessel 8 is infiltrated into the fiber bundle 3 with the effect that a uniform separation characteristic of the fibers is improved. The resultant fiber bundle is then introduced into the dryer 14, where a hot air blown from the blower 12 renders the infiltrated paste to be dry in the fiber bundle. The dried fiber bundle is introduced into the fiber separator 15. With the fiber separator 15, the fiber bundle is separated into the individual fibers in a direction of the axis of the separating roller 20 due to the bulging thick-center profile of each roller element 20*b*, while the running fiber bundle is in intermittent contact with the separating composite roller 20 or alternate contact with the respective roller elements 20*b*.

The separated fibers in the bundle are then subjected to tension by the upper and lower fixed rollers 21 with the effect that the separated fibers are flattened and the separation width W is kept. The resultant fiber bundle is then subjected to the hybrid treatment in the device 30. Thereafter, the fiber bundle is wound by the final drum 23 thereon. The winding is carried out while the final drum 23 is reciprocating axially, so that the fibers are wound in a spiral manner over the entire axial length of the drum 23.

In a case where a prepreg sheet is to be prepared with the separated fibers, the fiber reinforced metallic body is designed to have a thickness of 100 to 150 μm, the separation width W of the fiber bundle 3 is determined so as to have the fiber bundle form 3 to 5 fiber layers in a piled manner, each having substantially the same separation width W.

Figure 4:
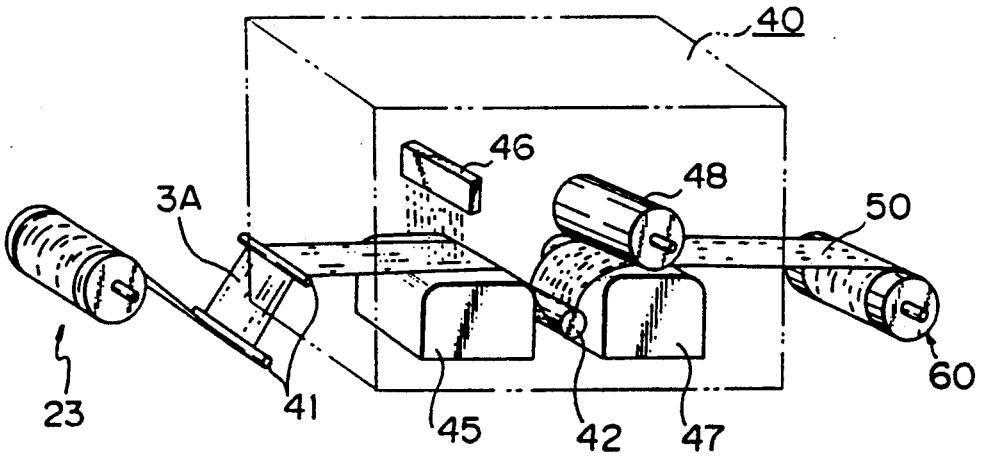
FIG. 4 shows a process of preparing a fiber reinforced metallic body according to the present invention, which process is carried out subsequent to the process as shown in FIG. 3.

The final drum 23 with the hybrid-treated fibers wound thereon is then subjected to the subsequent process of preparing a prepreg sheet forming the fiber reinforced metallic body as shown in FIG. 4.

Referring to FIG. 4, the drum 23 as a starting or initial drum is set to operate with an apparatus 40 so that the fibers on the drum 23 are forced to run through the apparatus 40 via guiding rollers 41, 42, and 43 (not shown) and are wound by a final drum 60 thereon. The fibers 3A from the drum 23 are preheated by a heater 45, and are then subjected to a plasma-spray of a matrix molten metal by a plasma-spraying device 46 to thereby form in combination with the melt a prepreg sheet 50 with the fibers embedded therein on the heater 45. The prepreg sheet 50 is guided by the roller 42 and introduced onto a heater 47. The prepreg sheet is pressed by a pressing roller 48 against an upper surface of the heater 47, whereby the prepreg sheet becomes dense with its surfaces being smooth. The prepared prepreg sheet 50 is then wound on the final drum 60.

According to the present invention, the plasma-spray of the molten metal is applied to the preheated fibers. This is advantageous in that the sprayed melt is smoothly and uniformly infiltrated into space gaps among the separated fibers with the result that the melt is adhered to the fibers uniformly.

Further, since the prepreg sheet is hot-pressed by the pressing roller 48 and the heater 47 in combination, adhesion of the fibers to the metal is improved and a high dense prepreg sheet is obtained.

It should be appreciated that the above mentioned processes as shown in FIGS. 3 and 4 can be applied effectively for preparing not only a fiber reinforced metallic body, but also a fiber reinforced resin body. Further, both the processes for preparing the fiber reinforced metallic or resin body as shown in FIGS. 3 and 4 may be, of course, combined to form a continuous process with the drum 23 being omitted.

With respect to the fiber separator, the present invention is not limited to the embodiment as shown in FIGS. 1 and 2. Another embodiment may be covered, wherein each corresponding roller element has a plurality of bulging thick center roller sections integrated to form a single rod. Each roller section has substantially the same profile as that of each roller element **20*b* as shown in FIG. 1**. The other embodied fiber separator is used for separating a plurality of fiber bundles concurrently on respective roller sections.

The roller elements forming the composite roller according to the present invention are preferably not free to rotate. If they are allowed to rotate when the fiber bundle runs in contact with the roller elements, a desired fiber separation cannot be always ensured.

We claim:

1. A fiber separator for flattening and separating a bundle of fibers into a plurality of individual fibers for use in producing a fiber reinforced metallic or resin body, comprising:

a pair of guide rollers, the fiber bundle running under tension in a direction of movement between said guide rollers;

a composite roller disposed between said guide rollers, including an axis;

means for rotating said composite roller in said direction of movement of the fiber bundle; and a plurality of stationary roller elements of the same size arranged about said composite roller radially spaced equally from said axis, each of said stationary roller elements having a smooth surface and a bulging thick-center profile along an axial section view, wherein said composite roller is positioned relative to the fiber bundle such that during one rotation about the axis, each of said stationary roller elements intermittently contacts the fiber bundle, and during a substantial portion of one rotation only one of said stationary roller elements at a time contacts the fiber bundle running under tension between said guide rollers, wherein a contacting angle $\theta$ of the fibers with the sole contacting stationary roller element is less than about 45°.

2. A fiber separator according to claim 1, wherein a surface line of each of said stationary roller elements in the axial sectional view has a radius of curvature ranging from 30 mm to 100 mm.

3. A fiber separator as in claim 1, including four of said stationary roller elements.

4. A fiber separator as in claim 2, including four of said stationary roller elements.

* * * * *